United States Patent [19]

Inoue et al.

[11] Patent Number: 4,785,435

[45] Date of Patent: Nov. 15, 1988

[54] SELF-CHARGEABLE ELECTRONIC TIMEPIECE WITH OPERATING VOLTAGE CHECKING

[75] Inventors: Yuichi Inoue; Chiaki Nakamura; Shuji Ohtawa; Hiroyuki Masaki, all of Tokyo, Japan

[73] Assignee: Seiko Instruments Inc., Tokyo, Japan

[21] Appl. No.: 35,087

[22] Filed: Apr. 6, 1987

[30] Foreign Application Priority Data

| | | | |
|---|---|---|---|
| Apr. 8, 1986 | [JP] | Japan | 61-80717 |
| Apr. 8, 1986 | [JP] | Japan | 61-80724 |
| Apr. 9, 1986 | [JP] | Japan | 61-81517 |
| Apr. 15, 1986 | [JP] | Japan | 61-86567 |

[51] Int. Cl.[4] ..... G04B 3/00

[52] U.S. Cl. ..... 368/205

[58] Field of Search ..... 368/204, 205

[56] References Cited

U.S. PATENT DOCUMENTS 4,702,613 10/1987 Ohtawa ..... 368/205

FOREIGN PATENT DOCUMENTS 100784 6/1985 Japan ..... 368/205

OTHER PUBLICATIONS

Congres International de Chronometrie, Besancon, 4–6, Oct. 1984, vol. 1, Congres 11, pp. 75–79, Takehide Yamada "No Battery Analog Quartz Watch".

*Primary Examiner*—Bernard Roskoski

*Attorney, Agent, or Firm*—Bruce L. Adams; Van C. Wilks

[57] ABSTRACT

A self-chargeable timepiece includes a pair of small and large capacitors having respective small and large capacities and selectively disconnectably connected at their respective terminals to time-keeping circuitry and a solar cell. The pair of small and large capacitors cooperate with each other during the momentary operation of the solar cell for selectively receiving and storing the electric charge to develop respective terminal voltages across their respective terminals even after the momentary operation of the solar cell. A detector periodically detects the terminal voltages of the small and large capacitors during the time-keeping operation. A switching circuit responds to the detected terminal voltages for selectively connecting and disconnecting the small and large capacitors to and from the time-keeping circuitry to enable the small and large capacitors to selectively power the time-keeping circuitry. A regulating circuit operates when the time-keeping circuitry is powered by the small capacitor for regulating the detector to effect the periodical detection of the terminal voltages at relatively short time intervals and operates when the time-keeping circuit is powered by the large capacitor for regulating the detector to effect the periodical detection of the terminal voltages at relatively long time intervals.

11 Claims, 8 Drawing Sheets

SELF-CHARGEABLE ELECTRONIC TIMEPIECE WITH OPERATING VOLTAGE CHECKING

BACKGROUND OF THE INVENTION

1. Field of the Invention

The present invention relates to a charge control function and a motor control circuit of a self-chargeable electronic timepiece in which a solar cell or a generator serves as a power source.

2. Description of the Prior Art

It has been heretofore desired to provide a self-chargeable electronic timepiece which comprises a primary power source such as a solar cell or a manually operated generator, and a secondary power source such as a plurality of condensers having different capacities.

Such an electronic timepiece has a condenser with a relatively large capacity which, when fully charged, is capable of driving the timepiece for several days, a condenser of a small capacity which can be instantaneously charged to produce a large voltage but which is capable of driving the timepiece for only several seconds, and a charge control circuit which connects and disconnects the primary power source to and from the secondary power source by detecting terminal voltages of both the condensers.

Operation of the charge control circuit consists of the following steps:

(a) In the initial state of charging, the primary power source is disconnected from the large capacity condenser, and an electric current is abruptly supplied only to the small capacity condenser.

(b) As the terminal voltage of the small capacity condenser rises over the operation voltage of the timepiece, the primary power source is connected to the large capacity condenser, and the large capacity condenser is electrically charged. Here, the timepiece is powered only by the small capacity condenser.

(c) As the terminal voltage of the small capacity condenser drops near to the minimum operation voltage of the timepiece, the primary power source is disconnected from the large capacity condenser again, and only the small capacity condenser is electrically charged.

(d) Then, the large capacity condenser is electrically charged while these steps (b) and (c) are being repeated. As the terminal voltage of the large capacity condenser rises over the operation voltage of the timepiece, both condensers are connected in parallel with each other, and both the large and small capacity condensers are electrically charged in the same terminal voltage. Here, the timepiece is powered by both of the condensers.

(e) As the terminal voltage of the large capacity condenser reaches near the maximum rating voltage thereof, the primary power source is short-circuited, and the charging operation is completed.

(f) As the terminal voltage of the large capacity condenser decreases near to the minimum operation voltage of the timepiece, the large capacity condenser is disconnected from the small capacity condenser, and only the small capacity condenser is electrically charged. Hereafter, the steps (b) and (c) are being repeated.

The conventional self-chargeable electronic timepiece as described above has may problems as follows:

First of all, time intervals for detecting the terminal voltage are the same for the small capacity condenser and the large capacity condenser. However, it is a tendency to employ a concenser having a small capacity in order to shorten the time for initiating the oscillation. Recently, furthermore, there has been proposed a primary power source which is capable of rapidly generating electricity, such as a manually operated generator. In this case, if the voltage detecting period is long, the current supply path is not properly switched, and the small capacity condenser loses its due to the terminal voltage in excess of the maximum rating voltage or, in the worst case, the small capacity condenser is broken down.

Moreover, when a step motor is stopped by the external operation, whole circuits are in reset condition. Namely, the detection of the terminal voltage of the condenser is not carried out. Therefore, when the charge/discharge control system is stopped under charging condition, the condensers are overcharged and may be deteriorated or broken down. On the contrary, when the system is stopped under discharging, the operation may not start again even after the reset condition is released.

Furthermore, there is no means for warning the necessity of charging in the above-mentioned steps (a) and (c). Therefore, it often happens that the timepiece ceases to operate without notice to the person who carries it.

Moreover, a large number of elements are used since a plurality of voltage levels have to be detected for each condenser, and the same voltage could not be detected since different voltage-dividing impedance elements have to be used for the power sources of which the terminal voltages are to be detected.

SUMMARY OF THE INVENTION

It is a principal object of the present invention to provide a charge control means which detects the terminal voltage at different periods when the timepiece is powered by a small capacity condenser and when the timepiece is powered by a large capacity condenser.

In the initial period of charging, the charging condition of the small capacity condenser can be detected at a short time interval, so that the small capacity condenser will not lose its performance due to a terminal voltage that exceeds the breakdown voltage thereof, or so that the small capacity condenser is prevented from being broken down. In the middle and last periods of charging, on the other hand, the voltage detecting period is extended so that the voltage is not detected unnecessarily.

It is another object of the present invention to provide first reset means which resets at least a step motor drive circuit under the reset condition but does not reset a frequency divider, and second reset means which resets at least the frequency divider for a short period of time just after the reset is released.

Owing to the provision of the above-mentioned reset circuit, a conventional charge/discharge system can be directly used, and the charging or discharging operation can be continued ordinarily even under the reset condition.

It is a further object of the present invention to provide a step motor driving circuit which controls a hand movement in a manner different from the normal hand movement when the terminal voltage of the large capacity condenser is smaller than a predetermined level.

According to the above-mentioned function, if the timepiece is powered only by the small capacity condenser, a person who it going to carry the timepiece must electrically charge the large capacity condenser until it generates a sufficiently large voltage, prior to carrying the timepiece. Therefore, the timepiece can be liberated from the problem that it ceases to operate immediately after it is being carried or it goes slow.

It is another object of the present invention to provide a voltage detecting means in which voltage-dividing impedance elements and a voltage comparator are commonly used for detecting two or more terminal voltages.

According to the above-mentioned structure, the number of elements for detecting voltages can be decreased.

DETAILED DESCRIPTION OF THE PREFERRED EMBODIMENT

Figure 1:
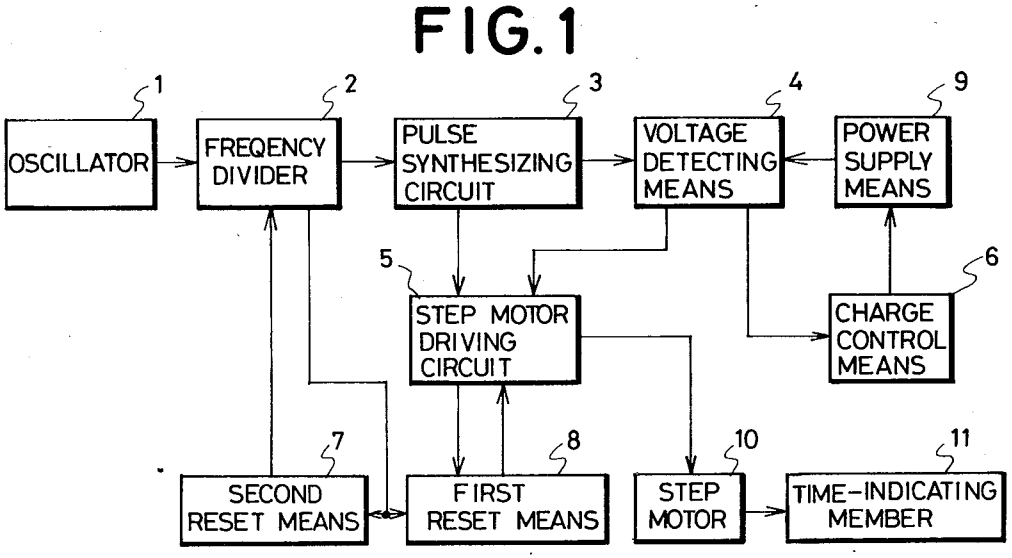
FIG. 1 is a block diagram of an electronic timepiece according to the present invention.

An embodiment of the invention will now be described in conjunction with the drawings. FIG. 1 is a block diagram showing the timepiece according to the present invention which comprises an oscillation circuit 1 which oscillates at 32768 Hz, a frequency-dividing circuit 2 which divides the frequency of outputs of the oscillation circuit 1, a pulse synthesizing circuit 3 which receives suitable signals from the frequency-dividing circuit 2 and which produces a signal required for the control circuits, a voltage detecting means 4 which receives a sampling signal from the pulse synthesizing circuit 3 and which detects the voltage of a plurality of condensers contained in a power supply means 9. Output terminals of the voltage detecting means 4 is connected to a charge control means 6 and to a step motor driving circuit 5. The charge control means 6 receives the output of the voltage detecting means, and controls the switching operation of the charge/discharge state of the plurality of condensers. The step motor driving circuit 5 receives the output of the voltage detecting means 4 and output of the pulse synthesizing circuit 3, and sends driving pulses to a step motor 10. The step motor 10 drives a time indicating member 11 such as hour, minute, and second hands to effect a time-keeping operation. The first reset means 8 stops the motor drive pulse from generating under the reset condition by an external operation, and the second reset means 7 resets the frequency divider 2 for a short period of time after the reset condition has been released.

Figure 2:
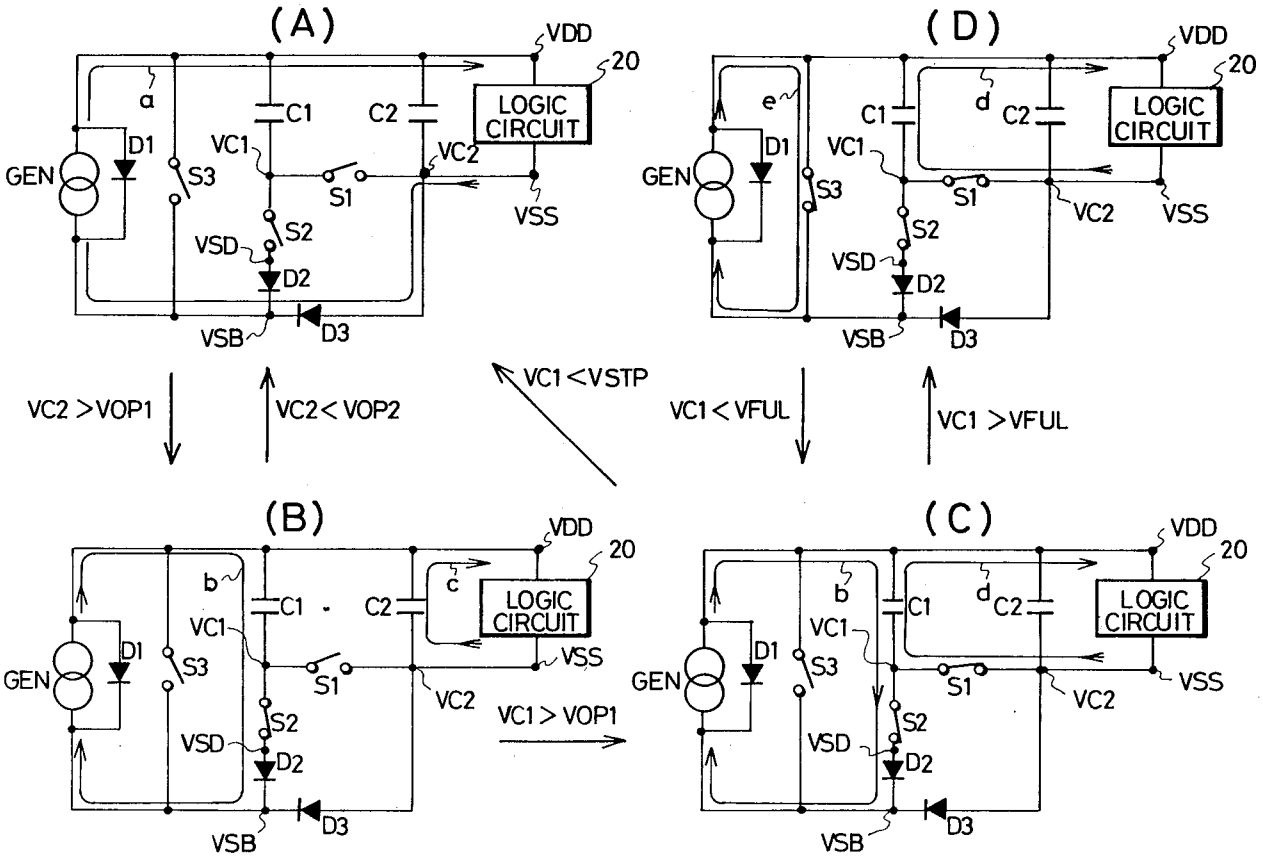
FIG. 2 is a diagram showing the states of charge control means according to the present invention.

FIG. 2 is a diagram showing the states of the charge control means 6 according to the present invention, wherein symbol GEN denotes a generating means for momentarily generating electric charge like a solar cell or manually operated generator, $C_1$ denotes an electric double-layer condenser or capacitor having a large capacity, for example, a capacity of 0.33 F, and $C_2$ denotes a tantalum condenser or capacitor having a small capacity of, for example, 6.8 $\mu$F. Symbols $D_2$ and $D_3$ denote reverse current-preventing diodes, and $D_1$ denotes a diode that is contained in the generator means. Symbols $S_1$, $S_2$ and $S_3$ denote switches for changing the loop for electric charge and discharge. Symbol $V_{C1}$ denotes a terminal voltage of the condenser $C_1$ with large capacity, $V_{C2}$ denotes terminal voltage of the tantalum condenser $C_2$, and $V_{DD}$ and $V_{SS}$ denote voltages with which the power supply means 9 drives a logic circuit 20 which comprises the circuits shown in FIG. 1.

Symbols $V_{SD}$ and $V_{SB}$ denote the anode voltage and cathode voltage, respectively, of the diode $D_2$. $V_{OP1}$ is defined as a voltage with which the logic circuit 20 operates sufficiently, $V_{STP}$ is defined as a minimum operating voltage of the logic circuit 20, $V_{OP2P}$ is defined according to the following relation:

$$V_{STP} < V_{OP2} < V_{OP1}$$

and $V_{FUL}$ denotes a maximum rating voltage of the condensers.

In FIG. 2, a state (A) shows the state under the conditions of $V_{C1} < V_{OP2}$, and $V_{C2} < V_{OP2}$. In this case, the switches $S_1$, $S_2$ and $S_3$ are all turned off, and an electric current generated from the generating means GEN is supplied to $V_{DD}$–$V_{SS}$ terminals through a loop "a". Therefore, the small capacity condenser $C_2$ is electrically charged immediately. Under the state (A), the voltage $V_{C2}$ is detected. If $V_{C2} > V_{OP1}$, the state (A) changes to the state (B). In the state (B), the switches $S_1$ and $S_3$ are turned off, and the switch $S_2$ is turned on. The generating means GEN and the large capacity condenser $C_1$ are connected to each other, and the electric current is charged into the condenser $C_1$ through the path "b". During this period, the potential $V_{C2}$ of $C_2$ is applied to $V_{DD}$–$V_{SS}$ terminal, and the discharge current flows from the condenser $C_2$ through a path "c". Under the state (B), the voltage $V_{C2}$ is detected. If $V_{C2} < V_{OP2}$, the state (B) returns to the state (A). The voltage $V_{C1}$ is also detected under the state (B). If $V_{C1} > V_{Op1}$, this state changes to the state (C). As will be explained below in detail, the hands are moved in the states (A) and (B) in a manner different from the normal hand movement.

In the state (C) of FIG. 2, the switches $S_1$ and $S_2$ are turned on, and the switch $S_3$ is turned off. This state is the normally used condition where the condensers $C_1$ and $C_2$ are connected in parallel with the generating means GEN to supply $V_{DD}$–$V_{SS}$ voltage. If $V_{C1} < V_{STP}$, this state returns to the state (A). Further, if $V_{C1} > V_{FUL}$, this state changes to the state (D). In the state (D), the switches $S_1$, $S_2$ and $S_3$ are turned on. With the switch $S_3$ being turned on, a voltage greater than $V_{FUL}$ is not applied to the condenser $C_1$. Namely, this prevents the overchanging. In this case, the voltage of the condenser $C_1$ is supplied to $V_{DD}$–$V_{SS}$ terminal. If the voltage $V_{C1}$ of the condenser $C_1$ becomes smaller than $V_{FUL}$, this state returns to the state (C). Under the states (C) and (D), the hands are normally moved every second.

Figure 3:
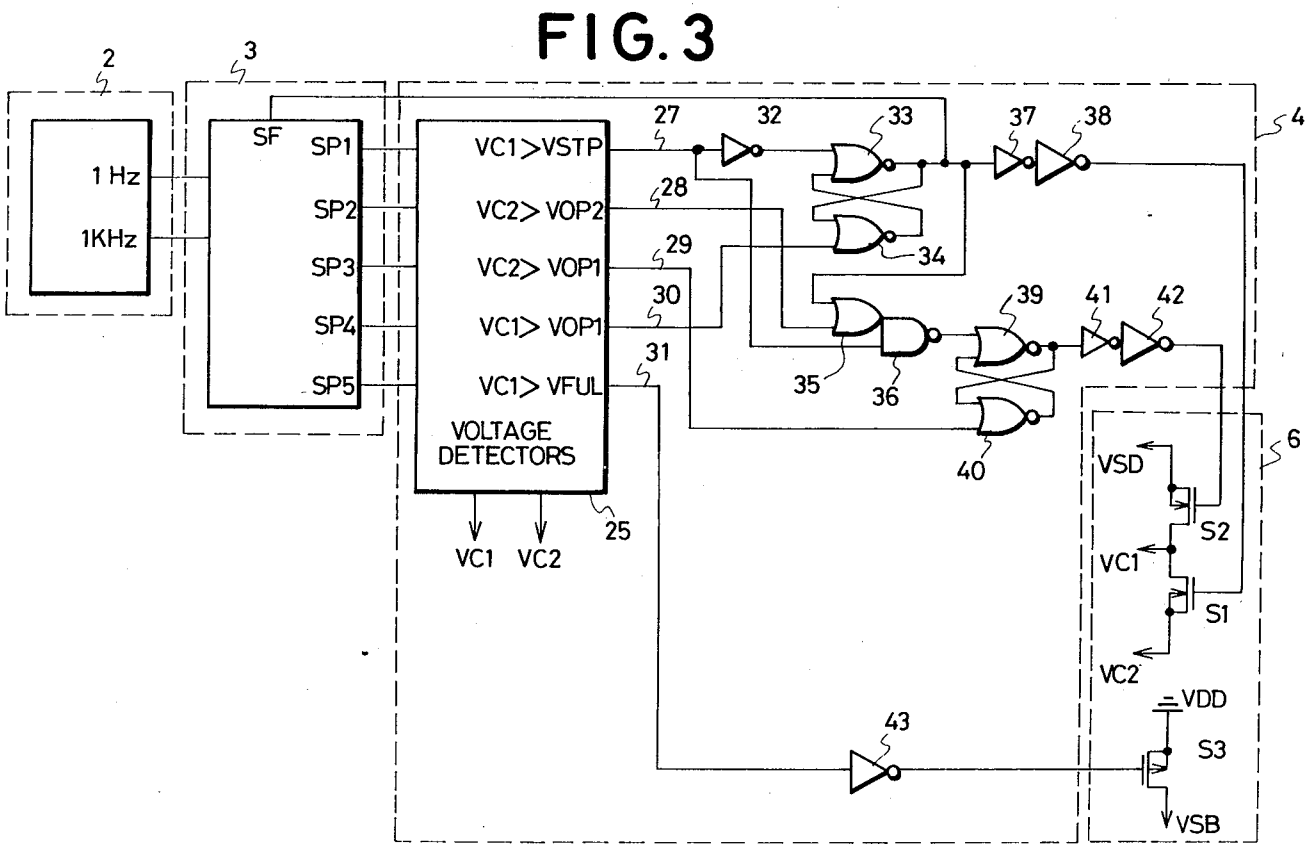
FIG. 3 is a circuit diagram of a voltage detecting means according to the present invention.

FIG. 3 illustrates the voltage detecting means 4 and charge control means 6, which enable the condition of the charge/discharge system of FIG. 2 to be changed according to the present invention.

The voltage detecting means 4 consists of a voltage detecting circuit 25 and a control circuit. The charge control means 6 consists of MOS switch transistors $S_1$, $S_2$ and $S_3$.

Voltage detecting operation and switching operation will now be described.

The voltage detecting output terminal 27 detects whether $V_{STP}>V_{C1}$. When $V_{C1}<V_{STP}$, the voltage detecting output terminal 27 holds "L" level, and the output of inverter 32 holds "H" level, whereby a latch circuit constituted by NOR gates 33 and 34 is reset, and switches $S_1$ and $S_2$ are turned off in response to the output of inverters 37, 38 and inverters 41, 42. This operation means that the state (C) of FIG. 2 is changed to the state (A).

The voltage detecting output terminal 28 detects whether $V_{OP2}>V_{C2}$. When $V_{C2}<V_{OP2}$, the voltage detecting outpt terminal 28 holds "L" level, whereby the latch circuit constituted by NOR gates 39 and 40 is reset, and switch $S_2$ is turned off in response to the output of an inverter 42. This operation means that the state (B) of FIG. 2 is changed to the state (A). Under the condition (C), however, the NOR gate 33 produces an output of "H" level, so that switch $S_2$ is not turned off.

The voltage detecting output terminal 29 detects whether $V_{OP1}<V_{C2}$. When $V_{C2}>V_{OP1}$, the voltage detecting output terminal 29 holds "H" level, whereby the latch circuit constituted by NOR gates 39 and 40 is set, and switch $S_2$ is turned on. This operation means that the state (A) of FIG. 2 is changed to the state (B).

The voltage detecting output terminal 30 detects whether $V_{OP1}<V_{C1}$. When $V_{C1}>V_{OP1}$, the voltage detecting output terminal 30 holds "H" level, whereby the latch circuit constituted by NOR gates 33 and 34 is set, and switch $S_1$ is turned on. This operation means that the state (B) shown in FIG. 2 is changed to the state (C).

The voltage detecting output terminal detects whether $V_{FUL}<V_{C1}$. When $V_{C1}>V_{FUL}$, the voltage detecting output terminal 31 holds "H" level and the output of inverter 43 holds "L" level, whereby switch $S_3$ is turned on. When $V_{C1}<V_{FUL}$, on the other hand, switch $S_3$ is turned off. This operation means that the state (C) of FIG. 2 is changed to the state (D), or vice versa.

The voltage detecting circuit 25 comprises these five kinds of voltage detectors. Sampling signals $SP_1$, $SP_2$, $SP_3$, $SP_4$ and $SP_5$ for these voltage detectors are supplied by the pulse synthesizing circuit 3, and a control signal $S_F$ selects a frequency of the sampling signals $SP_2$ and $SP_3$ which are used for detecting a terminal voltage $V_{C2}$ of the smaller capacity condenser $C_2$.

Figure 4:
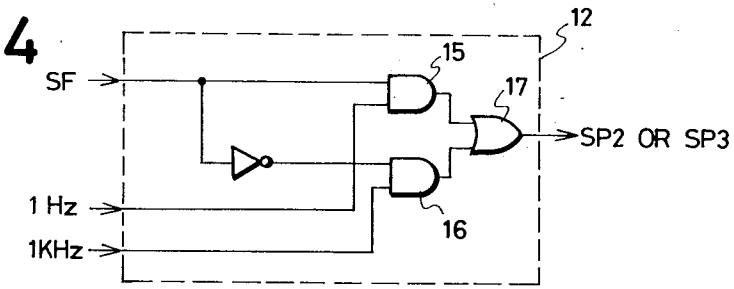
FIG. 4 is a simple circuit diagram of a sampling signal selecting circuit according to the present invention.

FIG. 4 is a simple circuit diagram which shows an embodiment of the sampling signal selecting circuit 12 as described above, and which is comprised of AND gates 15 and 16 which receive the control signal $S_F$ and frequency-divided signals of 1 Hz and 1 KHz send from the frequency-divider 2, and an OR gate 17 which receives outputs of the AND gates 15, 16 and which produces a sampling signal $SP_2$ or $SP_3$.

Operation of the thus constructed invention will now be described concretely. First, as the electric changing is initiated, the control signal $S_F$ holds "L" level so far as the condition $V_{C2}<V_{OP1}$ is maintained.

In FIG. 4, therefore, the gate 16 is turned on, the gate 15 is turned off, and the sampling signal $SP_2$ or $SP_3$ produced by the sampling signal selecting circuit 12 has a frequency of 1 KHz and that the terminal voltage of the condenser is detected at a relatively short period. Then, as the electric changing proceeds so that the conditions are $V_{C2}>V_{OP1}$ and $V_{C1}>V_{OP1}$, the control signal $S_F$ assumes "H" level. Therefore, the gate 15 is turned on, the gate 16 is turned off, and the sampling signal $SP_2$ or $SP_3$ produced by the sampling signal selecting circuit 12 has a frequency of 1 Hz and that the terminal voltage is detected at a relatively long period. Namely, under the states (A) and (B) (in FIG. 2) in which the small capacity condenser $C_1$ undergoes the charge/discharge operation, i.e., under the condition of $V_{C1}<V_{OP1}$, the time interval for detecting the voltage terminal is regulateably shortened to detect the voltage terminal at more frequently. Under the states (C) and (D) in which the large capacity condenser $C_2$ undergoes the charge/discharge operation, i.e., under the condition of $V_{C1}>V_{OP1}$, the time interval for detecting the terminal voltage is regulateably extended, such that the terminal voltage is detected less frequently to avoid an unnecessarily short time interval.

Figure 5:
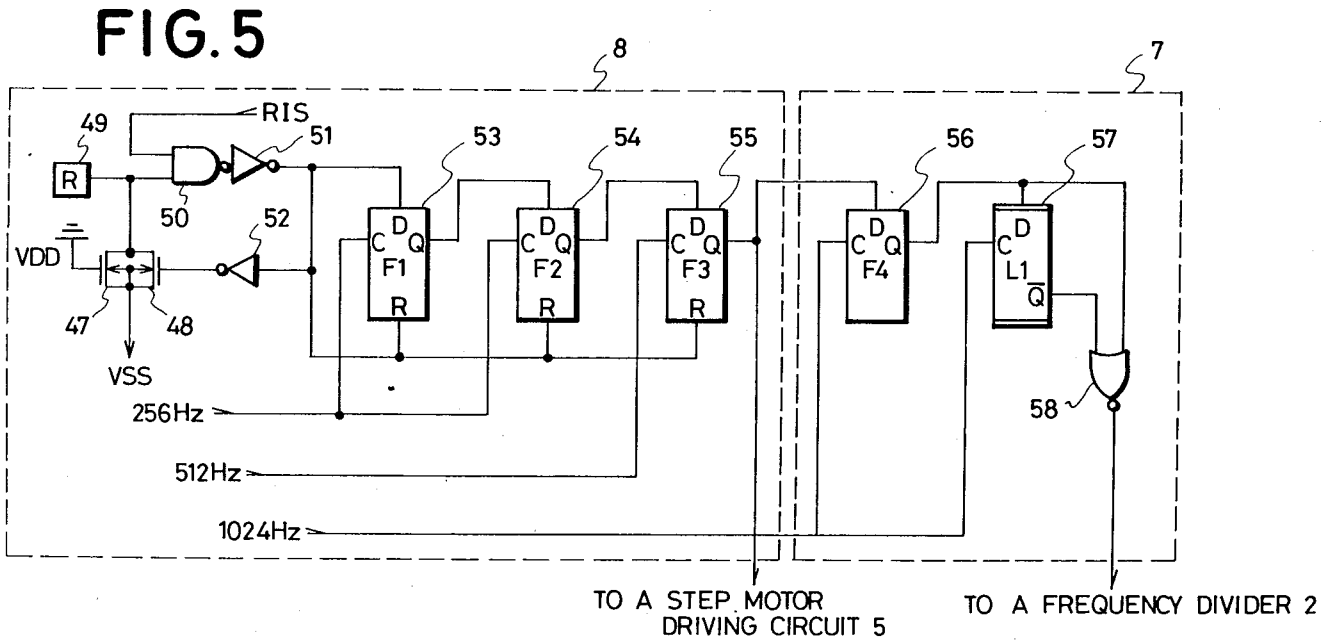
FIG. 5 is a circuit diagram of the first and second reset means according to the present invention.
Figure 6:
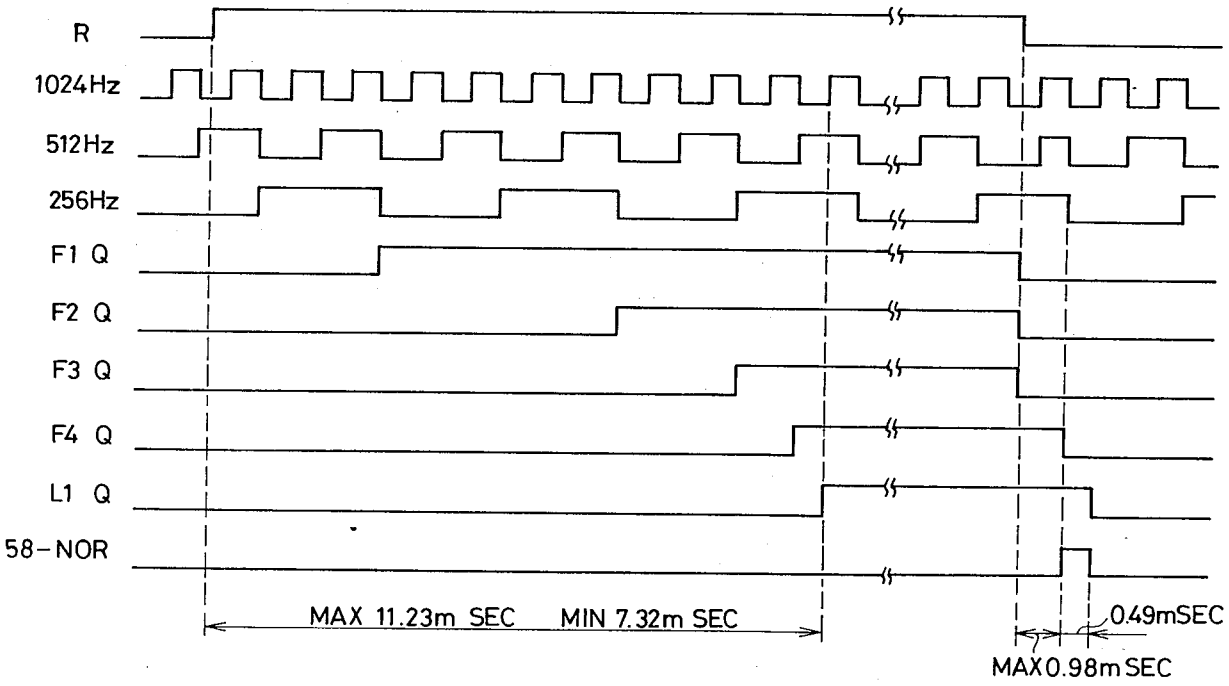
FIG. 6 is a timing chart associated with FIG. 5.

FIG. 5 concretely illustrates the first reset means 8 and the second reset means 7 according diagrammatically illustrated in to FIG. 1, and FIG. 6 is a timing chart thereof.

When the first reset means 8 is reset in response to an external operation, a reset terminal 49 assumes "H" level and the data is read through a chattering-preventing circuit which is constituted by flip-flops 53, 54, 55, 56 and 57. As shown in FIG. 6, the data is read during a time interval of 7.32 msec at the shortest and 11.23 msec at the longest. When the flip-flop 55 produces the output of "H" level, the step motor driving circuit 5 is reset to stop the step motor driving pulse from generating. Since the first reset means 8 does not reset at least the frequency divider 2, the voltage detecting means 4 operates in an ordinary manner.

Next, the second reset means 7 produces a one-shot pulse of a width of 0.49 msec after the reset is released. As the timing chart of FIG. 6 illustrates, the one-shot pulse is produced by a NOR gate 58 after a time duration of 0.98 msec has passed at the longest since the reset has been released. Using the one-shot pulse, the frequency-dividing stage subsequent to 512 Hz is reset, and a step motor driving pulse is produced after about one second has passed.

In a NAND gate 50, one of the input RIS is sent from the step motor driving circuit 5, and denotes an inhibition signal for resetting operation during the step motor driving signal is activated.

Figure 7:
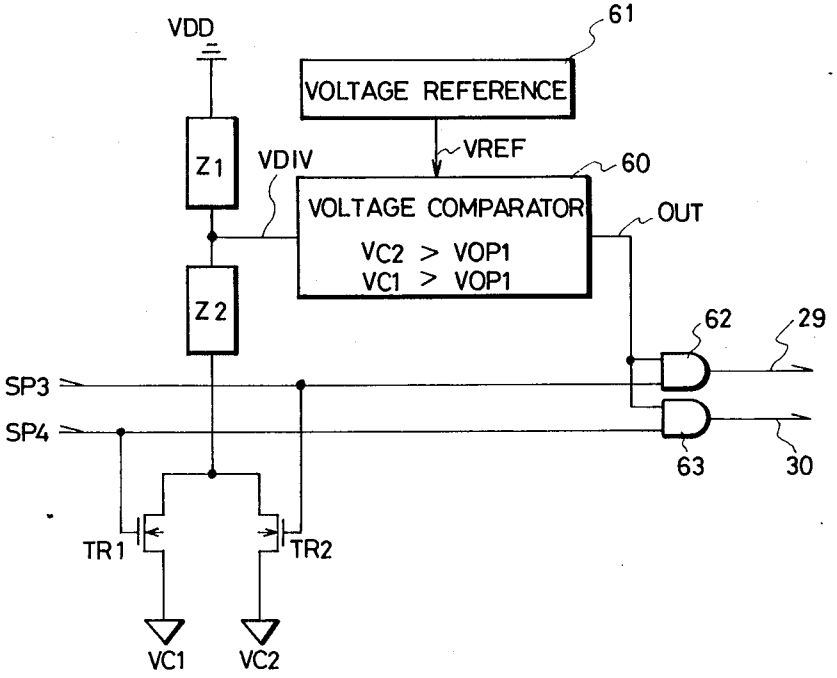
FIG. 7 is a circuit diagram of a voltage detector shown in FIG. 3.

FIG. 7 shows a circuit block diagram of the voltage detector for detecting whether $V_{C2}>V_{OP1}$ and whether $V_{C1}>V_{OP1}$ in the voltage detecting circuit 25 shown in FIG. 3. In general, each voltage detector consists of impedance elements which divide the terminal voltage $V_{C1}$ or $V_{C2}$ according to each detected voltage level, and a voltage comparator 60 which compares the divided terminal voltage $V_{D1V}$ with a reference voltage $V_{REF}$. In case of the FIG. 7 embodiment, the comparison voltage $V_{OP1}$ is the same for the terminal voltage $V_{C1}$ and $V_{C2}$ so that the impedance elements $Z_1$, $Z_2$ and voltage comparator 60 are used commonly in both of the detections of the terminal voltages $V_{C1}$ and $V_{C2}$.

Moreover, switching elements $TR_1$ and $TR_2$ which select the terminal voltage $V_{C1}$ or $V_{C2}$ to be detected, and AND gates 62, 63 which select the output of the voltage comparator 60 are provided. Operation of FIG. 7 will not be described. The sampling signal $SP_3$ or $SP_4$ produced from the pulse synthesizing circuit 3 turns the switching element $TR_1$ or $TR_2$ on, and the terminal voltage $V_{C1}$ or $V_{C2}$ to be detected is divided by the impedance elements $Z_1$ and $Z_2$. The divided voltage $V_{DIV}$ is compared by the voltage comparator 60 with the reference voltage $V_{REF}$, and the compared result is produced as a signal OUT. Upon receipt of the signal OUT, the voltage detecting output terminal 29 or 30 outputs the signal OUT through the AND gate 62 or 63 in accordance with the sampling signal $SP_3$ or $SP_4$.

Figure 8:
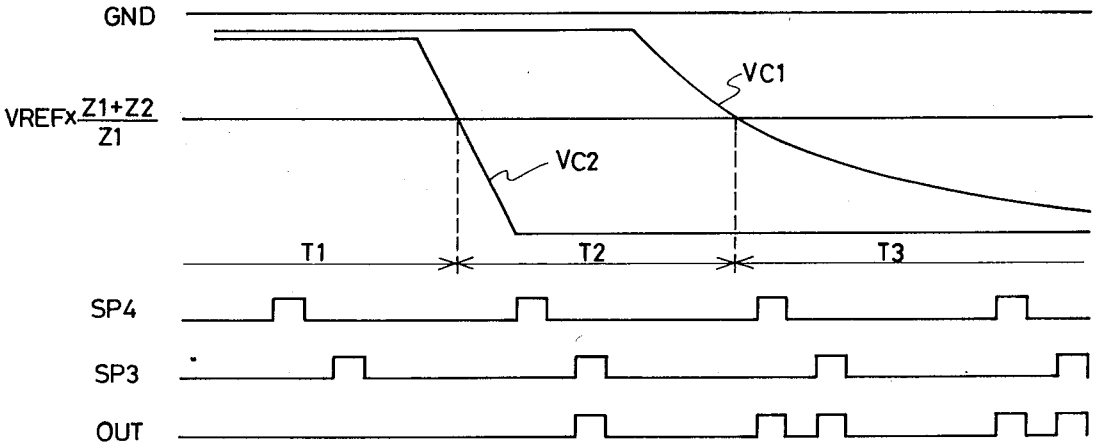
FIG. 8 is a timing chart associated with FIG. 7.

Next, the operation will be described further using the timing chart of FIG. 8. The sampling signals $SP_3$ and $SP_4$ are produced while maintaining a predetermined period, as required. For instance, these signals are produced as shown in FIG. 8. If the signal $SP_4$ assumes "H" level, the switching element $TR_1$ is turned on, and the terminal voltage $V_{C1}$ to be detected is divided by the impedance element $Z_1$ and $Z_2$. If the voltage drop through the switching element $TR_1$ is neglected, the divided voltage $V_{DIV}$ is given by $$VDIV(SP4)=VC1\times Z1/(Z1+Z2)$$

Similarly, if the signal $SP_3$ assumes "H" level, the divided voltage $V_{DIV}$ is given by $$VDIV(SP3)=VC2\times Z1/(Z1+Z2)$$

The comparator 60 compares the reference voltage $V_{REF}$ with the divided voltage $V_{DIV}$, and produces the result as a signal OUT. Therefore, the condition in which the signal OUT assumes "H" level is given by $$VC1>VREF\times(Z1+Z2)/Z1$$

$$VC2>VREF\times(Z1+Z2)/Z1.$$

Therefore, if the terminal voltages $V_{C1}$ and $V_{C2}$ to be detected change as shown in FIG. 8, the signal OUT holds it signal level in the sections T1, T2 and T3 as follows:

T1—The signal OUT does not assume "H" level in response to the signals $SP_3$ or $SP_4$.

T2—The signal OUT does not assume "H" level in response to the signals $SP_4$ but assumes "H" level in response to the signal $SP_3$.

T3—The signal OUT assumes "H" level in response to the signals $SP_3$ and $SP_4$.

Figure 9:
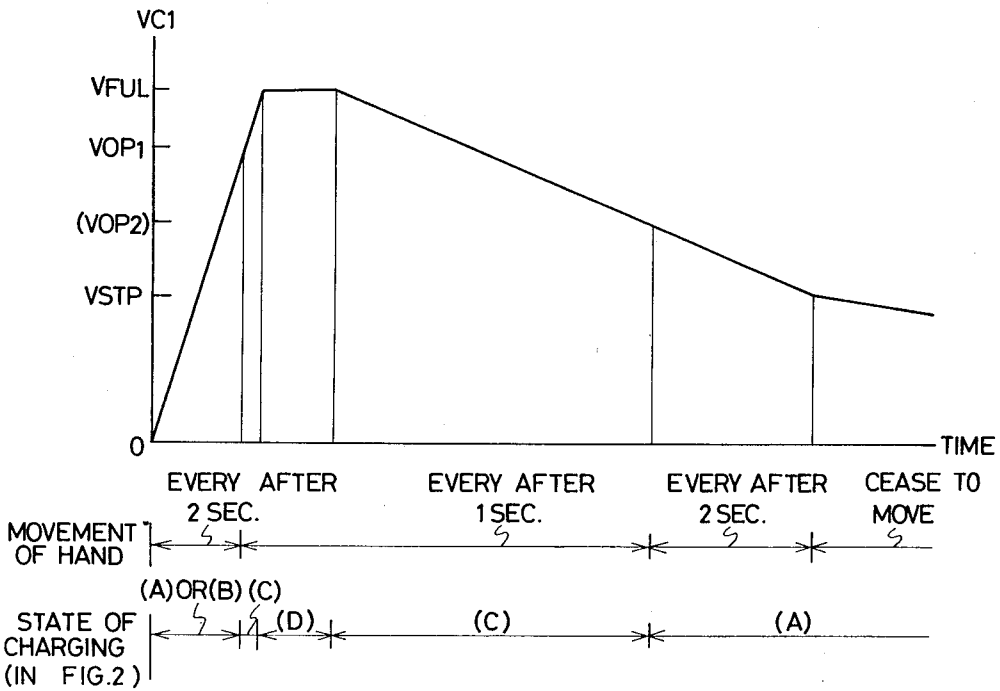
FIG. 9 is a graph showing the relationship between the terminal voltage $V_{C1}$ and the movement of hand according to the present invention.

FIG. 9 illustrates the relationship between the terminal voltage $V_{C1}$ and the movement of hand according to the present invention, wherein the charging operation is continued from when the terminal voltage $V_{C1}$ of the large capacity condenser $C_1$ is zero volt to when it is reached to $V_{FUL}$, and after the moment the charging operation is stopped. The condition (A) or (B) in FIG. 2 is established while the terminal voltage $V_{C1}$ falls within the range from 0 V to $V_{OP1}$. During this period, the step motor is driven by the terminal voltage $V_{C2}$. The hand is moved every after two seconds to warn that the timepiece will cease to operate soon if the charging operation is not carried out. As the charging operation is further continued, the state (C) is established where the step motor is driven by the terminal voltage $V_{C1}$, and the hand is normally moved every after one second. As the voltage $V_{C1}$ reaches $V_{FUL}$, the overcharge preventing state (D) is established, and the voltage $V_{C1}$ is clamped. If the charging operation is stopped at the moment, the voltage $V_{C1}$ gradually decreases due to the discharge of electricity and the hand is normally moved every after one second until the terminal voltage $V_{C1}$ decreases down to $V_{OP2}$. If the voltage $V_{C1}$ becomes smaller than $V_{OP2}$, the hand is moved again every after two seconds to warn that the voltage $V_{C1}$ is low. If the voltage $V_{C1}$ becomes lower than $V_{STP}$, the state (A) is resumed. If the charging operation is not carried out, the timepiece no more operates.

Though the above embodiment is so designed that the hand is moved every after two seconds while the voltage $V_{C1}$ ranges from 0 V to $V_{OP1}$, it is also allowable to move the hands in a different manner such as every after three seconds to distinguish the movement of hands over when the voltage $V_{C1}$ is smaller than $V_{OP2}$.

In a two-hand timepiece having a minute hand and an hour hand, furthermore, it is easy to move the hand in a manner that the step motor is turned forward and backward every after one second.

According to the present invention, as described in the foregoing, the charge control means is provided with a voltage sampling signal selecting circuit, and the period for detecting the terminal voltage of the condensers is varied depending upon the terminal voltage of the condensers, so that the small capacity condenser is not supplied with a voltage greater than the maximum rating voltage thereof and that the condenser will not lose performance or will not be broken down.

Furthermore, providing the first reset means and the second reset means, it is allowed to continue the charge/discharge operation irrespective to the reset condition or the non-reset condition without requiring any additional element.

While the timepiece is powered by the small capacity condenser only, the hands are mpoved in a manner different from the normal movement of hands, thereby to indicate that the capacitor is being electrically charged. This helps solve the problem that the timepiece ceases to operate while the possessor of the timepiece is not aware of this fact. Thus, there is provided a timepiece that can be used reliably.

Moreover, according to the voltage detecting circuit which employs a reduced number of elements to detect voltage, it is allowed to decrease the number of parts of an electronic timepiece or to reduce the size of the parts, and, hence, to reduce the size of the electronic timepiece and to decrease the manufacturing cost.

What is claimed is:

1. An electronic analog timepiece having a time-indicating member driven by a step motor with voltage checking function comprising:

oscillation means for generating a time base signal having a given frequency;

frequency dividing means for dividing the frequency of the time base signal to produce a divided signal;

pulse synthesizing circuit means for producing a plurality of control signals in response to the divided signal from the frequency dividing means;

step motor driving means for generating and controlling driving pulses effective to drive the step motor in response to the control signals of the pulse synthesizing circuit means;

power supply means including a primary power source for generating electric energy, and a secondary power source for accumulating the electric energy, the secondary power source being comprised of a first condenser having a relatively large capacity and a second condenser having a smaller capacity than that of the first condenser;

voltage detecting means including a plurality of voltage detectors for detecting a plurality of terminal voltages of the first condenser and the second condenser, respectively, and a sampling signal selecting circuit for producing a first sampling signal having a relatively long period effective to determine a relatively long time interval of the terminal voltage detection when the timepiece is powered by the first condenser having relatively large capacity and a second sampling signal having a relatively short period effective to determine a relatively short time interval of the terminal voltage detection when the timepiece is powered by the second condenser having relatively small capacity; and charge control means for controlling the accumulation and supply of the electric charge in the power supply means in response to the detecting result of the voltage detecting means.

2. An electric analog timepiece according to claim 1; wherein said plurality of voltage detectors comprise a plurality of switching elements for selecting the terminal voltage to be detected, and a voltage comparator for comparing the terminal voltage selected by the switching elements with a predetermined voltage.

3. An electronic analog timepiece according to claim 1; wherein said step motor driving means includes means for producing a first driving pulse for effecting normal advancement of the time-indicating member when the timepiece is powered by the first condenser having relatively large capacity, and for producing a second driving pulse for effecting modulated advancement of the time-indicating member in a manner different from the normal advancement thereof when the timepiece is powered by the second condenser having relatively small capacity.

4. An electronic analog timepiece according to claim 1; further comprising first reset means for resetting the step motor driving means but for resetting neither the oscillation means nor the frequency dividing means in response to an external operation; and second reset means for resetting at least the frequency dividing means for a short time after the external operation is released.

5. In an apparatus having time-keeping means for electrically effecting a time-keeping operation, and power supply means momentarily operable to generate electric charge effective to power the time-keeping means to maintain the time-keeping operation: a small capacity means and a large capacitive means having respective relatively small and relatively large capacities and each having a pair of terminals selectively disconnectably connected to the time-keeping means and the supply means, the small and large capacitive means being cooperative with each other during the momentary operation of the supply means for selectively receiving and storing the electric charge to develop respective terminal voltages across their respective terminals even after the momentary operation of the supply means; detecting means operative during the time-keeping operation for periodically detecting the terminal voltages of the small and large capacitive means; switch means responsive to the detected terminal voltages for selectively connecting the disconnecting the small and large capacitive means to and from the time-keeping means to enable the small and large capacitive means to selectively power the time-keeping means to thereby maintain the time-keeping operation thereof; and regulating means operative when the time-keeping means is powered by the small capacitive means for regulating the detecting means to effect the periodical detection of the terminal voltages at relatively short time intervals and operative when the time-keeping means is powered by the large capacitive means for regulating the detecting means to effect the periodical detection of the terminal voltages at relatively long time intervals.

6. An apparatus according to claim 5; wherein the switch means includes means operative when the momentary operation of the supply means is initiated for disconnecting the large capacitive means from the time-keeping means and the supply means to enable the small capacitive means to quickly build up its terminal voltage.

7. An apparatus according to claim 6; wherein the switch means includes means operative when the terminal voltage of the small capacitive means exceeds a given value for connecting the large capacitive means to the supply means.

8. An apparatus according to claim 7; wherein the switch means includes means operative when the terminal voltage of the large capacitive means exceeds a given value for connecting the large capacitive means to the time-keeping means.

9. An apparatus according to claim 8; wherein the switch means includes means operative when the terminal voltage of the small capacitive means exceeds a rating value thereof for effectively disconnecting the small and large capacitive means from the supply means.

10. An apparatus according to claim 5; wherein the time-keeping means includes a time-indicating hand, a stepping motor for stepwisely rotating the hand, and driving means operative when the time-keeping means is powered by the large capacitive means for driving the stepping motor to effect a normal stepwise rotation of the hand and operative when the time-keeping means is powered by the small capacitive means for driving the stepping motor to effect an abnormal stepwise rotation of the hand.

11. An apparatus according to claim 5; wherein the time-keeping means includes a time-indicating hand, a stepping motor for stepwisely rotating the hand, and driving means operative when the time-keeping means is powered by the large capacitive means for driving the stepping motor to effect a normal stepwise rotation of the hand and operative when the time-keeping means is powered by the small capacitive means for suspending the driving of the stepping motor.

* * * * *